US007089575B2

(12) United States Patent
Agnihotri et al.

(10) Patent No.: US 7,089,575 B2
(45) Date of Patent: Aug. 8, 2006

(54) METHOD OF USING TRANSCRIPT INFORMATION TO IDENTIFY AND LEARN COMMERCIAL PORTIONS OF A PROGRAM

(75) Inventors: Lalitha Agnihotri, Fishkill, NY (US); Nevenka Dimitrova, Yorktown, NY (US); Thomas Francis McGee, Garrison, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 1079 days.

(21) Appl. No.: 09/945,871

(22) Filed: Sep. 4, 2001

(65) Prior Publication Data

US 2003/0050926 A1 Mar. 13, 2003

(51) Int. Cl.
*H04H 9/00* (2006.01)
*H04H 7/16* (2006.01)
*H04H 5/91* (2006.01)

(52) U.S. Cl. ..... 725/20; 725/18; 725/19; 725/22; 386/46

(58) Field of Classification Search ..... 725/18–20, 725/22, 32, 34–35
See application file for complete search history.

(56) References Cited

U.S. PATENT DOCUMENTS 4,857,999 A * 8/1989 Welsh ..... 725/22
5,835,667 A 11/1998 Wactlar et al. ..... 386/96
5,859,662 A * 1/1999 Cragun et al. ..... 725/137
5,903,262 A * 5/1999 Ichihashi et al. ..... 725/136
6,061,056 A * 5/2000 Menard et al. ..... 715/704
6,100,941 A 8/2000 Dimitrova et al. ..... 348/700
6,580,437 B1 * 6/2003 Liou et al. ..... 715/719
6,597,405 B1 * 7/2003 Iggulden ..... 348/553
6,637,032 B1 * 10/2003 Feinleib ..... 725/110
6,704,929 B1 * 3/2004 Ozer et al. ..... 725/13
6,708,335 B1 * 3/2004 Ozer et al. ..... 725/20
2001/0003214 A1 * 6/2001 Shastri et al. ..... 725/109
2003/0023972 A1 * 1/2003 Gutta et al. ..... 725/34
2005/0015795 A1 * 1/2005 Iggulden ..... 725/20

FOREIGN PATENT DOCUMENTS

EP 0648054 A2 4/1995
EP 0780777 A1 6/1997
EP 0903676 A2 3/1999
WO 9820675 A1 5/1998

OTHER PUBLICATIONS

PHA 23,832, U.S. Appl. No. 09/441,943, filed: Nov. 17, 1999.

(Continued)

*Primary Examiner*—Christopher Grant
*Assistant Examiner*—Chris Parry

(57) ABSTRACT

Advertisers want to deliver their message in a relatively short period of time. This leads to the product name, company name and other identifying features being repeated frequently during a commercial broadcast. Transcript information can be used to detect commercials by detecting frequently occurring words in the commercials. This can also be used to identify an individual commercial from other commercials. Once the individual commercials have been identified, the transcript information corresponding to each commercial can be stored in a database to identify the commercial in subsequent broadcasts, or to provide a search mechanism for searching a particular commercial in the database.

45 Claims, 3 Drawing Sheets

OTHER PUBLICATIONS

PHA 23,839, U.S. Appl. No. 09/441,949, filed: Nov. 17, 1999.
PHA 23,803, U.S. Appl. No. 09/417,288, filed: Oct. 13, 1999.
US 000397, U.S. Appl. No. 09/739,476, filed: Dec. 18, 2000.
US 000279, U.S. Appl. No. 09/712,681, filed: Nov. 14, 2000.
Shift or Algorithm, pp. 186-192, Computer Science and Engineering Handbook, by Allen C. Tucker, 1997.

* cited by examiner

METHOD OF USING TRANSCRIPT INFORMATION TO IDENTIFY AND LEARN COMMERCIAL PORTIONS OF A PROGRAM

BACKGROUND OF THE INVENTION

1. Field of the Invention

The present invention is directed to identifying and learning commercials during a program such as a broadcast television program, and more specifically to identifying and learning commercials during a broadcast television program using transcript information.

2. Description of the Related Art

Television viewing systems are available which automatically detect selected segments of a television signal such as commercial advertisements or undesired portions of the program. These commercial detection systems are typically used to mute the audio portion of the television broadcast when the undesired portion of the program appears, or for controlling a video player to skip the undesired portion of the program during recording or replay. Although a wide variety of techniques have been developed for detecting selected segments of television programs, none of the prior art systems monitor the transcript information (e.g., closed-captioned signal) of a television program to identify and learn the commercial portions which occur during the program. In addition, none of the prior art systems identify, segment and store individual commercials which occur during a commercial segment of the program for later use, for example, to create a library of commercials to identify corresponding commercial portions of subsequent television broadcasts.

OBJECTS AND SUMMARY OF THE INVENTION

It is therefore an object of the present invention to provide a method which identifies and learns commercial portions of a broadcast program.

It is another object of the present invention to provide a method which monitors the transcript information corresponding to a broadcast program to identify and learn commercial portions of the broadcast program.

It is a further object of the present invention to provide a method which identifies, segments and learns individual commercials which are broadcast during a commercial segment of a broadcast program by analyzing the transcript information associated therewith.

It is a further object of the present invention to provide a method for identifying and learning commercial portions of a broadcast program which overcome inherent disadvantages of known commercial detection methods.

In accordance with one form of the present invention, a method of identifying commercial segments during a program includes the steps of using transcript information associated with the program, detecting "non-stop" words in the transcript information during a first time period which occur more than a predetermined number of times, detecting "non-stop" words in the transcript information during a second time period which occur more than a predetermined number of times, and comparing the non-stop words detected during the first time period and the "non-stop" words detected during the second time period.

In accordance with another form of the present invention, a method of learning and storing commercial segments which occur during a program includes the steps of identifying a possible commercial segment which occurs during the program, comparing "non-stop" words of the possible commercial segment with "non-stop" words of each of a list of probable commercial segments previously identified to determine at least one matching probable commercial segment, comparing transcript text of the possible commercial segment with transcript text of the at least one matching probable commercial segment, storing the transcript text which is common to both the possible commercial segment and the at least one matching probable commercial segment, removing the at least one matching stored probable commercial segment from the list of probable commercial segments, and adding the at least one matching probable commercial segment to a list of candidate commercial segments.

In accordance with another form of the present invention, a method of learning and storing commercial segments which occur during a program includes the steps of identifying a possible commercial segment which occurs during the program, comparing "non-stop" words of the possible commercial segment with "non-stop" words of each of a list of candidate commercial segments previously identified to determine at least one matching candidate commercial segment, comparing transcript text of the possible commercial segment with transcript text of the at least one matching candidate commercial segment, storing the transcript text which is common to both the possible commercial segment and the at least one matching candidate commercial segment, removing the at least one matching candidate commercial segment from the list of candidate commercial segments, and adding the at least one matching candidate commercial segment to a list of found commercial segments.

In accordance with another form of the present invention, a method of learning and storing commercial segments which occur during a program includes the steps of identifying a possible commercial segment which occurs during the program, comparing "non-stop" words of the possible commercial segment with "non-stop" words of each of a list of found commercial segments previously identified to determine at least one matching found commercial segment, comparing the transcript text of the possible commercial segment with transcript text of the at least one matching found commercial segment, storing the transcript text which is common to both the possible commercial segment and the at least one matching found commercial segment, and incrementing a counter which indicates the frequency of occurrence of the at least one matching found commercial segment. The method also includes adding the found commercial segment to a found commercial list.

In accordance with another form of the present invention, a method of retrieving a stored commercial segment includes the steps of identifying at least one non-stop word indicative of a commercial segment which is desired, identifying stored commercial segments which correspond to the identified non-stop word, and outputting the identified stored commercial segments which correspond to the identified non-stop words. The method further includes marking the identified stored commercial segment as a commercial area.

The above and other objects, features and advantages of the present invention will become readily apparent from the following detailed description thereof, which is to be read in connection with the accompanying drawing.

DETAILED DESCRIPTION OF THE PREFERRED EMBODIMENT

Figure 1:
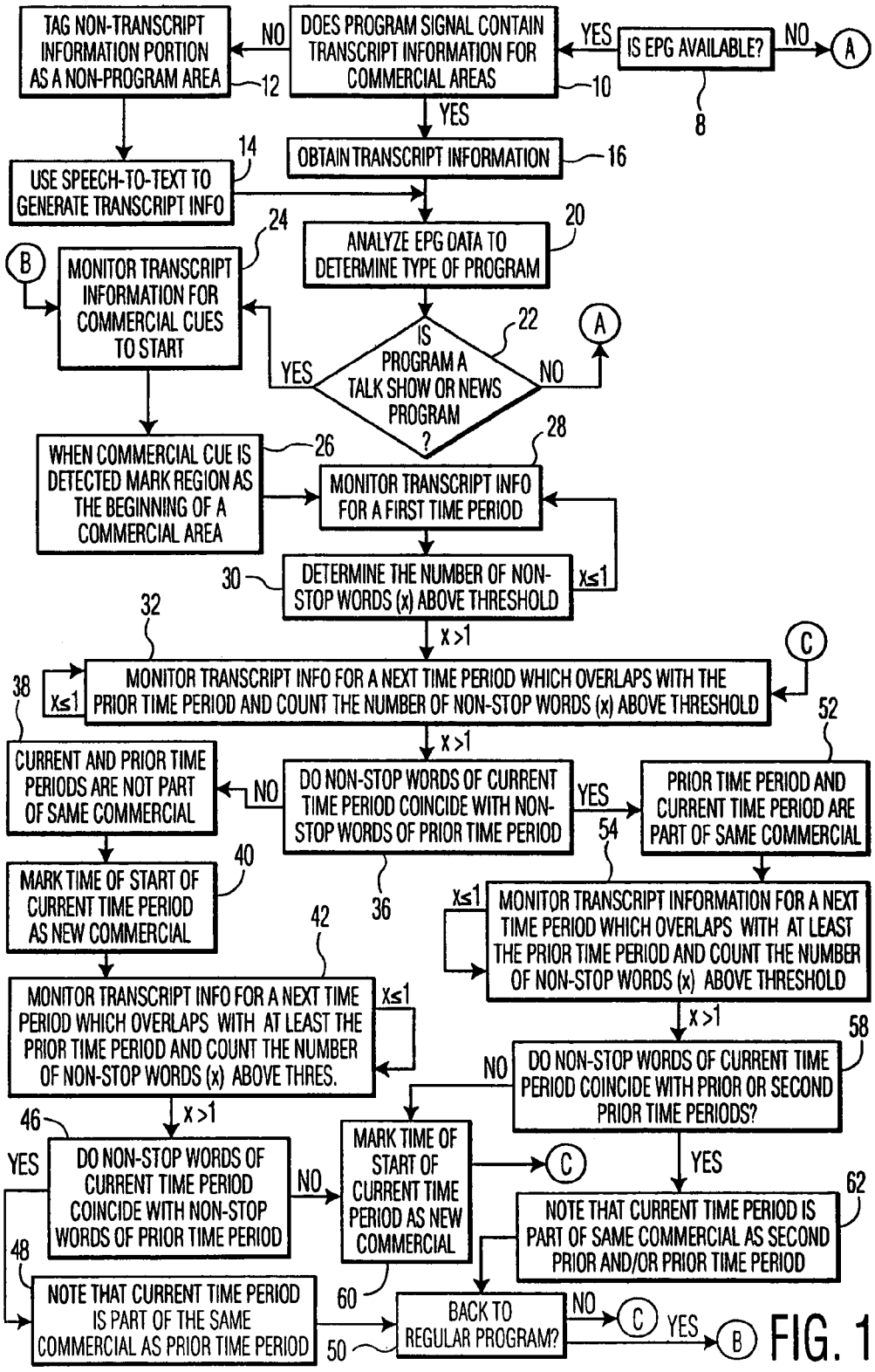
FIG. 1 is a flow diagram of the method of using transcript information to identify commercial portions of a program in accordance with the present invention.

Referring now to the drawings, the method for using transcript information to identify and learn commercial portions of a program is shown. The term transcript information is intended to indicate text, for example, closed-captioned text, which is typically provided with a video program's transmission (audio/data/video) signal and which corresponds to the spoken and non-spoken events of the video program or other textual source like EPG (electronic programming guide) data. The transcript information can be obtained from video text or screen text (e.g., by detecting the subtitles of the video) and by applying optical character recognition (OCR) on the extracted text such as that disclosed in U.S. Ser. No. 09/441,943 entitled "Video Stream Classification Symbol Isolation Method and System" filed Nov. 17, 1999, and U.S. Ser. No. 09/441,949 entitled "Symbol Classification with Shape Features Applied to a Neural Network" filed Nov. 17, 1999, the entire disclosures of each of which are incorporated herein by reference.

If the audio/data/video signal does not include a text portion (i.e., it does not include transcript information), transcript information can be generated using techniques such as speech-to-text conversion (if subtitles exist, subtitle recognition using OCR is employed to generate transcript information) as known in the art. The transcript information may also be obtained from a third party source, for example, TV Guide via the internet.

The present invention is based on the knowledge that the transcript information of a program is capable of being analyzed and searched using known searching techniques such as key-word searching and statistical text indexing and retrieval. Generally, the method for commercial segment identification includes analyzing the transcript information corresponding to a program (audio, video, data and the like) and determining the beginning of a commercial portion of the program (or the end of a non-commercial portion of the program by identifying "going into commercial" cues in the transcript information as explained in more detail below). Once the beginning of a commercial portion of the program has been identified, the method analyzes the transcript information to separately identify individual commercials contained within the identified commercial portion of the program. The signatures of individually identified commercials are then compared to previously identified signatures (previously stored) of commercial segments, stored as separate entities in a database, to identify specific commercial portions of the commercial segment. Once the commercial segments have been stored in the database, the user can access the database to search for a particular commercial. Alternative to the foregoing, any standard commercial detection technique based on audio/video characteristics can be used to tentatively determine commercial areas, such as those disclosed in U.S. Ser. No. 09/417,288 filed Oct. 13, 1999 entitled Automatic Signature-Base Spotting, Learning and Extracting of Commercials and Other Video Content by Dimitrova, McGee, and Agnihotri, and U.S. Ser. No. 09/123,444 filed Jul. 28, 1998 entitled Apparatus and Method for Locating a Commercial Disposed Within a Video Data Stream by Dimitrova, McGee, Elenbaas, Leyvi, Ramsey and Berkowitz, the entire disclosures of which are incorporated by reference.

Referring initially to FIG. 1, a preferred embodiment of the present invention is shown. The method includes determining whether EPG data is available for the received (audio/data/video) program signal (Step 8). If EPG data is not available (NO in Step 8), the method continues with Step 62 (see FIG. 2). If EPG data is available (YES in Step 8), the method then determines whether the received program (audio/data/video) signal includes transcript information for the entertainment (non-commercial) portion and the commercial (advertising) portion of the program (Step 10). If the received program signal does not include transcript information for the entertainment and commercial portions, and the transcript information is not available from a third party source, the method of the present invention employs known speech-to-text conversion techniques to provide the necessary transcript information. If the program signal includes transcript information for the entertainment portion but does not include transcript information for the commercial portions of the program (NO in Step 10), and if transcript information is not available from a third party source for the commercial portions of the program, the portions of the program which do not include the transcript information are tagged as non-program areas (i.e., a commercial/advertising region) (Step 12). Then speech-to-text conversion is employed (Step 14) to generate the necessary transcript information for the non-program areas.

If the program signal does contain transcript information for the entertainment and the commercial portions of the program (Yes in Step 10), the transcript information is extracted from the program signal (Step 16). The EPG data signal is then analyzed to determine the type of program (Step 20) (e.g., talk show, news program, etc). Other program type determining methods can be employed such as those which analyze the transcript information for cues as to the program type such as those disclosed in U.S. Ser. No. 09/739,476 filed Dec. 18, 2000 entitled Apparatus and Method of Program Classification Using Observed Cues in the Transcript Information, by Kavitha Devara, and U.S. Ser. No. 09/712,681 filed Nov. 14, 2000 entitled Method and Apparatus for the Summarization and Indexing of Video Programs Using Transcript Information, by Lalitha Agnihotri, Kavitha Devara and Nevenka Dimitrova, the entire disclosures of which are incorporated herein by reference.

If the EPG data indicates that the program is of the type which would provide cues in the spoken text as to the occurrence of a commercial (such as a news program or a talk show), this fact is noted (Step 22). News programs and talk shows provide cues as to the occurrence of commercials (called "going into commercial" cues) with phrases such as "when we come back", "still ahead", "after these messages", "after the commercial break", and "up next". When these phrases are identified in the transcript information, there is a high degree of certainty that a commercial segment is soon to follow. If the program is a talk show or news program (Yes in Step 22), the transcript information is monitored for the occurrence of the commercial cues (Step 24). When a commercial cue is detected, the region is marked as the beginning of a commercial segment of the program (Step 26). Thereafter, the transcript information is monitored for a first time period (Step 28) for "non-stop" words which occur above a predetermined threshold (Step 30). It should be noted that news programs and talk shows also provide cues in the text as to a return from a commercial break to regular programming when the host of the news program or talk show says things like "welcome back". When such a phrase is identified in the transcript information, there is a high degree of certainty that a commercial segment has ended.

Non-stop words are words other than "an", "the", "of", etc. The inventors have recognized that advertisers desire to deliver their message in a very short period of time. We can have recognition of brand names/database aids in labeling commercials. This leads to the product name, company name and other identifying features being repeated frequently during a commercial segment. If non-stop words (common to a product being advertised) appear numerous times during a relatively short time period during the program, this is indicative of a commercial. In one embodiment the time period is about 15 seconds and the method determines whether non-stop words are mentioned more than once during the time period. If non-stop words above the predetermined threshold are identified in Step 30 (X>1 in Step 30), the transcript text is monitored for a second time period (which preferably overlaps with the prior time period) and the non-stop words which occur more than the predetermined number of times in the second time period are noted (Step 32). If at least one non-stop word occurs more than a predetermined number of times (X>1 in Step 32), then a determination is made as to whether the non-stop words of the current time period coincide with the non-stop words of prior time periods (Step 36).

If the non-stop words identified in the current time period and the prior time period do not coincide (i.e., they do not have at least one common non-stop word) (NO in Step 36), then the current and prior time periods are not part of the same commercial segment (Step 38) and the start of the current time period is marked as the start of a new commercial segment (Step 40). Thereafter, the transcript information is monitored for a next time period which overlaps with at least the prior time period and the non-stop words which occur more than a predetermined number of times above a threshold are noted (Step 42).

If in Step 42 non-stop words are identified which occur more than a predetermined number of times (X>1 in Step 42), a determination is made as to whether the non-stop words of the current time period coincide with the non-stop words of prior time periods (Step 46). If the non-stop words of the current time period coincide with non-stop words of a prior time period (YES in Step 46), then a notation is made that the current time period is part of the same commercial as the prior time period (Step 48). Thereafter, a determination is made as to whether the current transcript information corresponds to a return to the non-commercial portion of the program (Step 50). If it is determined that the current transcript information corresponds to a return to the non-commercial portion of the program (YES in Step 50) (e.g., the host of the show says "Welcome back"), the method returns to Step 24. However, if it is determined that the current transcript information is not indicative of a return to the non-commercial portion of the program (NO in Step 50), then the method returns to Step 32 to monitor the transcript information for a new time period.

If in Step 36 it is determined that the non-stop words of the current time period coincide with non-stop words of a prior time period (YES in Step 36), then it is determined that the prior time period and the current time period are part of the same commercial segment (Step 52). Thereafter, the transcript information is monitored for a next time period which preferably overlaps with at least the prior time period. The non-stop words which occur more than a predetermined number of times are noted (Step 54).

If the non-stop words occur more than a predetermined number of times in the current time period (X>1 in Step 54), a determination is made as to whether the non-stop words of the current time period coincide with the non-stop words of the prior time periods (Step 58). If the non-stop words of the current time period do not coincide with the non-stop words of any one of the prior time periods (NO in Step 58), then the beginning of the current time period is marked as the start of a new commercial segment (Step 60). Thereafter, the method returns to Step 32.

If the non-stop words identified in the current time period coincide with the non-stop words of one of the prior time periods (YES in Step 58), then a notation is made that the current time period is part of the same commercial as the corresponding prior time period which has the same non-stop words (Step 62). Then a determination is made as to whether the current transcript information is indicative of a return of the non-commercial portion of the program (Step 50). If it is determined that the current transcript information corresponds to a return to the non-commercial portion of the program (YES n Step 50), the method returns to Step 24. However, if it is determined that the current transcript information is not indicative of a return to the non-commercial portion of the program (NO in Step 50), then the method returns to Step 32.

Figure 2:
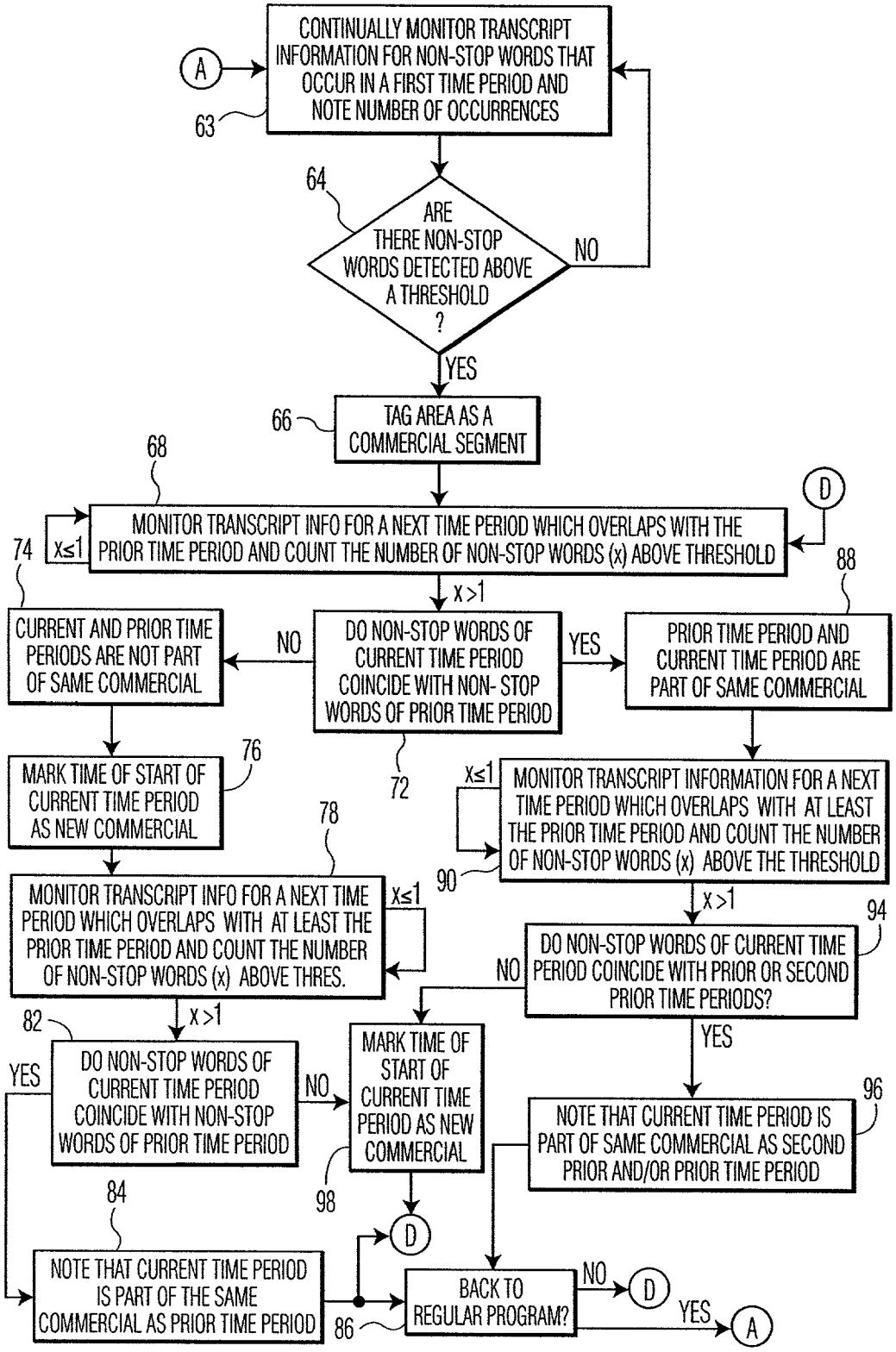
FIG. 2 is a flow diagram of the method of using transcript information to identify commercial portions of a program in accordance with the present invention, FIG. 2 being a continuation of FIG. 1.

Returning now to Step 8, if it is determined that EPG data is not available (NO in Step 8), then the method continues with Step 63 shown in FIG. 2. Similarly, if a determination is made in Step 22 that the current program is not a talk show, news program or other program which provides commercial cues to indicate the beginning of a commercial segment of a program (NO in Step 22), then the method continues with Step 63 shown in FIG. 2.

Turning now to FIG. 2, if the beginning of a commercial segment cannot be identified by either commercial cues or EPG data, the transcript information for the program is continually monitored for specific time periods to identify non-stop words that occur. Thereafter the number of occurrences of each of the non-stop words which occur in the predetermined time period are noted (Step 63). Thereafter, a determination is made as to whether the detected non-stop words occur more than a predetermined number of times within the time period (Step 64). If non-stop words do not occur more than a predetermined number of times in the time period (NO in Step 64), the method returns to Step 63 wherein the transcript information is monitored for non-stop words. If, however, non-stop words are identified in the time period and the non-stop words occur more than a predetermined number of times (YES in Step 64), then the portion of the program which corresponds to the time period is identified as the beginning of a commercial segment (Step 66). Thereafter, the transcript information is monitored for a next time period which overlaps with the prior time period and the non-stop words which occur more than a predetermined number of times are noted (Step 68). If individual non-stop words occur in the time period more than a pre-determined number of times (X>1 is Step 68), then a determination is made as to whether the non-stop words of the current time period coincide with the non-stop words of a prior time period (Step 72).

If the non-stop words identified in the current time period and the non-stop words of the prior time period do not coincide (NO in Step 72), then the current and prior time periods are not part of the same commercial segment (Step 74) and the start of the current time period is marked as the start of a new commercial (Step 76). Thereafter, the transcript information is monitored for a next time period which overlaps with at least the prior time period and the non-stop words which occur more than a predetermined number of times above a threshold are noted (Step 78).

If in Step 78, non-stop words are identified in which occur more than a predetermined number of times (X>1 in Step 78), a determination is made as to whether the non-stop words of the current time period coincide with the non-stop words of prior time periods (Step 82). If the non-stop words of the current time period coincide with non-stop words of a prior time period (YES in Step 82), then a notation is made that the current time period is part of the same commercial as the prior time period (Step 84). Thereafter, a determination is made as to whether the current transcript information corresponds to a return to the non-commercial portion of the program (Step 86). If it is determined that the current transcript information corresponds to a return to the non-commercial portion of the program (YES in Step 86), the method returns to Step 63. However, if it is determined that the current transcript information is not indicative of a return to the non-commercial portion of the program (NO in Step 86), then the method returns to Step 68 to monitor the transcript information for a new time period.

If in Step 72, it is determined that the nonstop words of the current time period coincide with non-stop words of a prior time period (YES in Step 72), then it is determined that the prior time period and the current time period are part of the same commercial segment (Step 88). Thereafter, the transcript information is monitored for a next time period which preferably overlaps with at least the prior time period and the non-stop words which occur more than a predetermined number of times are noted (Step 90). If non-stop words occur more than a predetermined number of times in the current time period (X>1 in Step 90), a determination is made as to whether the non-stop words of the current time period coincide with the nonstop words of the prior time periods (Step 94). If the non-stop words of the current time period do not coincide with the non-stop words of any one of the prior time periods (NO in Step 94), then the start of the current time period is marked as the start of a new commercial (Step 98). Thereafter, the method returns to Step 68. If the non-stop words identified in the current time period coincide with the non-stop words of the prior time periods (YES in Step 94), then a notation is made that the current time period is part of the same commercial as the prior time period which has the same non-stop words (Step 96). Then a determination is made as to whether the current transcript information is indicative of a return of the non-commercial portion of the program (Step 86). If it is determined that the current transcript information corresponds to a return to the non-commercial portion of the program (YES in Step 86), the method returns to Step 63. However, if it is determined that the current transcript information is not indicative of a return to the non-commercial portion of the program (NO in Step 50), then the method returns to Step 68).

Based upon the above analysis, if non-stop words occur multiple times in a given time segment, and the same words occur for example in the next two overlapping time segments, the method stores the transcript text from the beginning of the first time period to the end of the third time segment as a possible commercial. Further, if it so happens that certain words occur multiple times in the third time segment and continue to occur until the sixth time segment, then the method stores the transcript text from the beginning of third time segment to the end of sixth time segment as a next commercial. The next time similar keywords are observed, then a sub-segment matching method can be used (explained below) to match the current possible commercial to the two commercials that are stored. This will match the overlapping part of one text to the other possible commercial texts. Assuming that the current commercial is bounded by different commercials than the prior occurrence of the same commercial, the next time the commercial appears, only the center portion of both the segments match the current commercial. This enables extraneous portions of the commercial segments to be removed from the stored commercial and what is left is only the subject commercial. This might include only a part of the first time segment, the entire second time segment and a part of the third time segment as the actual commercial.

As a result of the present invention, individual commercials of a multi-commercial portion of a broadcast program can be identified using transcript information and can be separated from each other and individually stored in memory for a variety of uses such as identifying individual commercials during a program and searching for a particular type of commercial (auto) or a commercial for a particular product (Honda Accord).

Based on analysis of actual broadcast commercials, the inventors have determined that if a non-stop word occurs at least three times within a pre-determined time period (15 seconds), this is indicative of the occurrence of a commercial. The inventors have discovered that it is unlikely that a non-stop word would occur in a non-commercial portion of a program more than three times during any 15 second interval.

The following text is the closed-captioned text extracted from the Late-Night Show with David Letterman which includes two commercials.

| | |
|---|---|
| 1367275 | I'll tell you what, ladies and |
| 1368707 | gentlemen, when we come back |
| 1369638 | we'll be playing here. |
| 1373975 | (Cheers and applause) |
| 1374847 | (band playing) of using a dandruff shampoo |
| 1426340 | Note how isolated it makes people feel. |
| 1430736 | Note its unpleasant smell, the absence of rich lather. |
| 1433842 | Note its name. Nizoral a–d. |
| 1437276 | The world's #1 prescribed ingredient for dandruff . . . |
| 1440019 | In non-prescription strength. |
| 1442523 | People can stay dandruff free by doing this with nizoral a–d |
| 1444426 | only twice a week. |
| 1447560 | Only twice a week. What a pity. |
| 1449023 | Nizoral a–d; |
| 1451597 | I see skies of blue |
| 1507456 | and clouds of white |
| 1509419 | the bright, blessed day |
| 1512724 | the dogs say good night |
| 1515728 | and i think to myself . . . |
| 1518432 | Discover estee lauder pleasures |
| 1520105 | and lauder pleasures for men. |
| 1521937 | Pleasures to go. For her. |
| 1524842 | For him. |
| 1526674 | Each set free with a purchase |
| 1527806 | of estee lauder pleasures |
| 1528947 | of lauder pleasures for men. |
| 1530450 | . . . Oh, yeah. |
| 1532052 | |
| 1534155 | |
| 1566922 | (Band playing) |
| 1586770 | >>dave: It's flue shot friday. |
| 1587572 | You know, i'd like to take a |
| 1588473 | minute here to mention the . . . |

The closed-captioning text demonstrates the effectiveness of the invention wherein the words "Nizoral", "A-D", "dandruff", and "shampoo" appeared at least three times during the first commercial (15 second) segment between time stamps 1374847 and 1449023. Moreover, the words "lauder" and "pleasures" appeared more than three times in the second commercial between time stamps 1451597 and 1528947. This is based on the fact that advertisers want to deliver their message in a short period of time and therefore must frequently repeat the product name, company and other identifying features of the product to the audience to convey the desired message and information in a short period of time. By detecting the occurrence of these non-stop words in the transcript information in a predetermined time period, individual commercials can be detected and separated from each other.

After a commercial portion of a program has been identified, the individual commercials within the commercial portion of a broadcast are preferably separated from one another and stored in memory/database for retrieval at a later time, (e.g., so that a user could retrieve a car advertisement by searching the memory/database of commercials) within the memory/database which stores the individual commercials to present the user with commercials which match the user's requirements.

Figure 3:
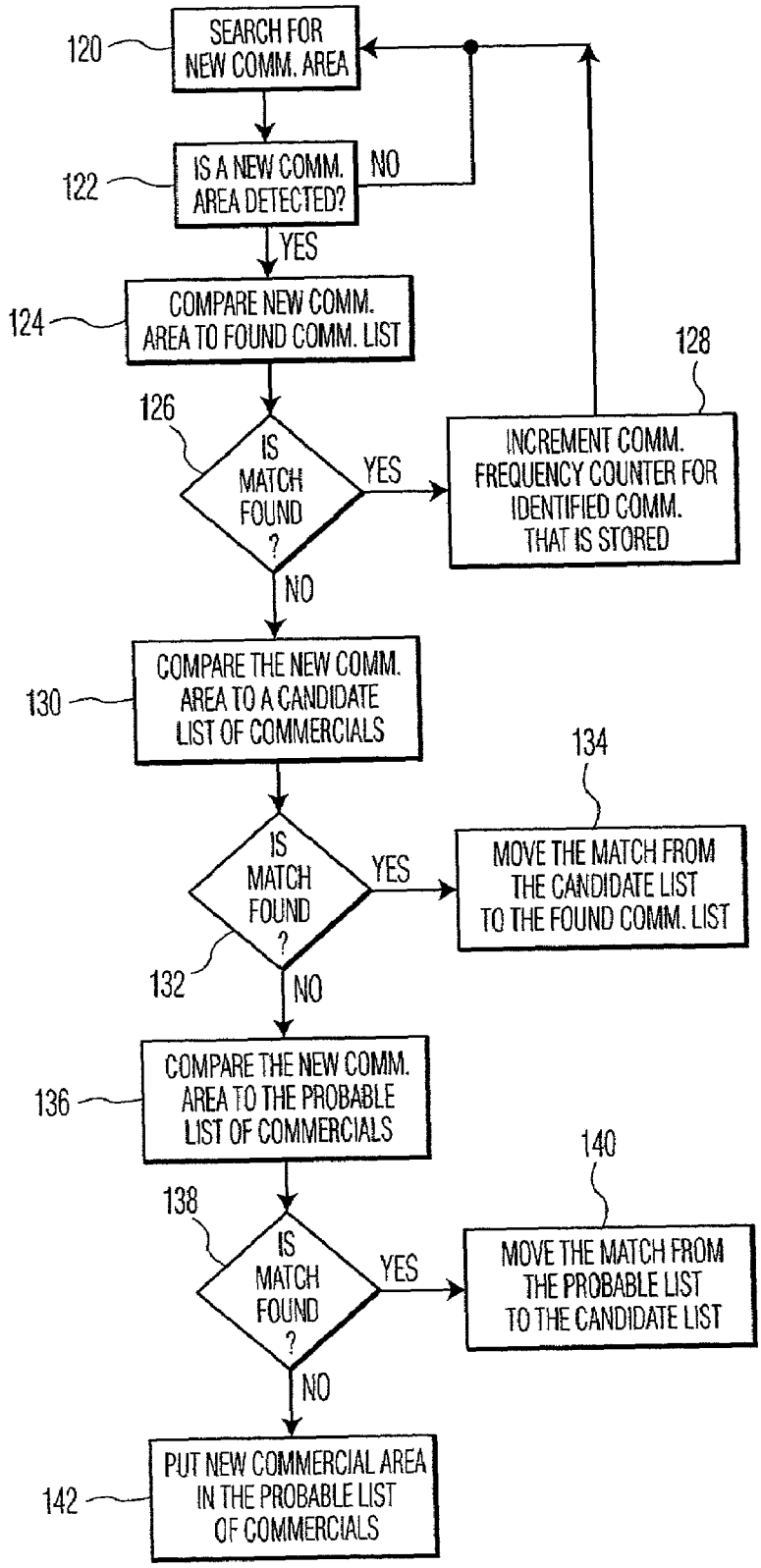
FIG. 3 is a flow diagram of the method of learning commercial portions of a program in accordance with the present invention.

Turning now to FIG. 3, the method for learning commercials is shown wherein the memory/database which stores the identified commercials includes commercial segments which are stored in the found commercial list, the candidate commercial list, and the probable commercial list.

Initially, a search for a new commercial area is conducted (Step 120). The search for a commercial area may correspond to the methods shown in FIGS. 1 and 2 described above or other known commercial detection methods such as those disclosed in U.S. Ser. No. 69/123,444 filed Jul. 28, 1998 entitled "Apparatus and Method for Locating a Commercial Disposed Within a Video Data Stream", by Nevenka Dimitrova, Thomas McGee, Herman Elenbaas, Eugene Leyvi, Carolyn Ramsey and David Berkowitz, the entire disclosure of which is incorporated herein by reference. A determination is then made as to whether a new commercial area is detected (Step 122). If a new commercial area is not detected (NO in Step 122), then the method returns to Step 120 where the search is continued for a new commercial area. However, if a new commercial area is detected (YES in Step 122), then the non-stop words which occur more than a predetermined number of times which correspond to the new commercial area are compared with the non-stop words of the commercials which are part of the "found" commercial list (Step 124). The found commercial list corresponds to commercials which have been identified more than twice and therefore a high degree of certainty exists as to the correctness of the "non-stop" words and transcript text which is stored. If a match between the non-stop words of the new commercial area and the non-stop words of one of the commercials listed in the found commercial list is identified (YES in Step 126), then a counter corresponding to the identified commercial is incremented to indicate that this is an active commercial which still appears during broadcast programs (Step 128). If the counter is not incremented for a period of time, (e.g., 1 month) then the commercial and the corresponding non-stop words and transcript text are purged from memory because the commercial is not active. Alternatively, the commercial can be retained indefinitely in the database.

If the non-stop words of the new commercial area do not correspond to non-stop words of the commercials contained in the list of found commercials (NO in Step 126), then a comparison is made between the non-stop words of the new commercial area and the non-stop words of the commercials of the candidate list of commercials (Step 130). If the non-stop words of the new commercial area match the nonstop words of at least one of the commercials identified in the candidate list (YES in Step 132), then the commercial which was identified in the candidate list is deleted from the candidate's list and moved to the found commercial list along with the corresponding non-stop words and transcript text (Step 134). If, however, the non-stop words of the new commercial area do not match the non-stop words of the commercials contained in the candidate list (NO in Step 132), then a comparison is made between the non-stop words of the new commercial area and the non-stop words contained in the probable list of commercials (Step 136). If a match is found between the non-stop words of the new commercial area and the non-stop words of one of the commercials contained in the probable list of commercials (YES in Step 138), then the commercial identified from the list of probable commercials is deleted from the probable list of commercials and moved to the candidate list of commercials (Step 140). If, however, a match between non-stop words of the new commercial area and the non-stop words of one of the commercials contained in the list of probable commercials is not obtained, then the new commercial area which includes the identified non-stop words and the transcript text are stored in the probable list of commercials (Step 142).

In view of the method shown in FIG. 3, whenever a new potential commercial area is detected, the non-stop words identified in the transcript information are compared with the non-stop words from the found list, candidate list, and probable list of commercials which were previously identified. If the non-stop words of the new potential commercial do not match the non-stop words of the commercials identified in the found list, candidate list, or probable list of commercials, then the new potential commercial is added to the probable list of commercials. That is, the non-stop words of the new potential commercial and the actual transcript of a new potential commercial are added to the probable list of commercials. However, if some of the non-stop words of the new potential commercial match the non-stop words of at least one of the commercials identified in one of the found list, candidate list, or probable list of commercials, the transcript text of the new potential commercial and the matching commercial from the list of commercials are compared using an approximate matching technique such as approximate string matching "Shift-Or Algorithm" as described at pages 186–192 of the Computer Science and Engineering Handbook, by Allen C. Tucker (Editor-in-Chief) 1997, the disclosure of which is incorporated herein by reference. The "Shift-Or-Algorithm" accounts for spurious characters (words, phrases, sentences) that may be introduced into the text due to multiple sources from where the transcript text is obtained or generated. By using the "Shift-Or-Algorithm" the transcript text which is common to the new potential commercial and the commercial identified from the list of commercials is retained and the text which is not coincident is ignored. Typically the text which is ignored occurs at the beginning or end of the actual commercial due to the absence of non-stop words or because these portions belong to a commercial segment which was adjacent (contiguous) with the newly identified commercial segment.

It is important to note that the above learning procedure is run continuously for programs that do not contain "going into commercial clues".

The present invention is designed to store the transcripts and optionally a signature along with the commercial in a database. The system may also be coupled to a service provider which downloads or provides access to all of the currently airing commercials, or a memory/database of current commercials could be coupled to the system to provide commercial knowledge at initial start-up of the system. When the user wants to retrieve a specific type of advertisement (e.g., a car advertisement), the user can provide search parameters and a simple string matching will retrieve the desired commercial, searching the found list, candidate list and probable list in order. In addition, the transcripts of the stored commercials can be used as signatures to identify the advertisement during a broadcast program at a later time. The signature can also be used by advertisers to ensure that their commercials have been aired.

It should also be mentioned that the time periods for monitoring non-stop words can be any desired length. Since commercials are typically only 15 to 30 seconds long, it has been found that the time period should be preferably about 15 seconds in duration. While it is foreseen that the time periods need not overlap, it has been determined that overlapping time periods is preferable. In one example the first time period covers the time from zero seconds to 15 seconds, the second time period covers a time period from 5 seconds to 20 seconds, a third time period covers the period from 10 seconds to 25 seconds and the fourth time period covers a time from 15 seconds to 30 seconds. With this time period structure a more definitive indication of a beginning or end of commercial segments can be provided. If it is determined that the first, second and third time periods have the same non-stop words, then the transcript information for the first, second and third time periods are presented for storage together in the database.

It should be noted that the total number of time periods which can be linked together should be set to a limit (of about the equivalent of one or two minutes) so that an entire program is not stored due to the repetition of certain words or names. For example, since commercials are rarely over a minute long, no more than 12 overlapping 15 second windows as described above should be grouped together as a possible commercial.

It should also be noted that it is foreseen that the present invention could provide the user with links related to commercials that are viewed that the user might be interested in visiting. For example, if a user is viewing a particular car commercial, the user can be presented with loan commercials, car insurance commercials and/or car dealerships whose commercials are stored in the database.

It is also foreseen that the apparatus can include a database of commercials and brand names. If a specific brand name as identified by the database is mentioned numerous times within a predetermined period of time, this is indicative of the occurrence of a commercial. The database of commercials and commercial names can also aid in labeling a commercial as being for a particular product, and to identify how many commercials there are in a given commercial segment.

It is also foreseen that commercial segments of a program can be identified by observing the length (i.e., number of words) of each line of closed-captioned text. The system could determine a running average of words/line. If the number of words in a specific number of lines exceeds the running average, or if the closed-captioned format changes, this is indicative of a commercial segment.

Having described specific embodiments of the invention with reference to the accompanying drawing, it will be appreciated that the present invention is not limited to those precise embodiments and that various changes and modifications can be effected therein by one of ordinary skill in the art without departing from the scope or spirit of the invention defined by the appended claims.

The invention claimed is:

1. A method of identifying commercial segments during a program comprising:

a. receiving an audio/data/video signal which includes at least one of transcript information and electronic programming guide (EPG) data and using the transcript information associated with the program;

b. detecting "non-stop" words in the transcript information during a first time period which occur more than a predetermined number of times;

c. detecting "non-stop" words in the transcript information during a second time period which occur more than a predetermined number of times;

d. comparing the "non-stop" words detected during the first time period and the "non-stop" words detected during the second time period; and e. analyzing the transcript information and the electronic programming guide (EPG) data to determine a type of program being broadcast and whether the type of program being broadcast includes "going into commercial" and "going out of commercial" cues.

2. The method of identifying commercial segments according to claim 1 wherein the second time period overlaps in time with respect to the first time period.

3. The method of identifying commercial segments according to claim 1, wherein if the "non-stop" words detected during the first time period which occur more than the predetermined number of times are different from the "non-stop" words detected during the second time period which occur more than the predetermined number of times, the first time period is indicative of a first commercial segment and the second time period is indicative of a second commercial segment; and wherein if at least one of the "non-stop" words detected during the first time period which occur more than the predetermined number of times is the same as at least one of the "non-stop" words detected during the second time period which occur more than the predetermined number of times, the first time period and second time period are indicative of a common commercial segment.

4. The method of identifying commercial segments according to claim 3 further comprising the steps of:

detecting "non-stop" words in the transcript information during a third time period which occur more than a predetermined number of times, wherein if the "non-stop" words detected during the third time period which occur more than the predetermined number of times are different from the "non-stop" words detected during the second time period and the first time period, the third time period is indicative of a commercial segment which is not associated with the commercial segment of either of the first or second time periods, and wherein if the "non-stop" words detected during the third time period which occur more than the predetermined number of times are the same as the "non-stop" words detected during at least one of the second time period and the first time period, the third time period is indicative of a commercial segment which is associated with the commercial segment of the corresponding first or second time period.

5. The method of identifying commercial segments according to claim 4 wherein the third time period overlaps in time with respect to at least the second time period.

6. The method of identifying commercial segments according to claim 1, further comprising:

continuously monitoring the program for a beginning of a commercial segment, wherein steps b–d are performed only after the beginning of a commercial segment has been identified.

7. The method of identifying commercial segments according to claim 6 wherein the step of continuously monitoring the program comprises the step of monitoring the transcript information associated with the program.

8. The method of identifying commercial segments according to claim 6 wherein if the transcript information is being monitored, a beginning of a commercial segment is detected if a number of occurrences of "non-stop" words during a predetermined time period is at least equal to a predetermined value.

9. The method of identifying commercial segments according to claim 1, wherein if the type of program does not include "going into commercial" cues, the method further comprises:

continuously monitoring the transcript information for a beginning of a commercial segment by searching for the occurrence of "non-stop" words above a predetermined value in a predetermined time period.

10. The method of identifying commercial segments according to claim 1, wherein if the type of program does not include "going into commercial" cues, continuously monitoring the audio/data/video signal for a portion which does not include transcript information and designating the corresponding portion of the program as a commercial segment.

11. The method of identifying commercial segments according to claim 1, wherein if the type of program does not include "going into commercial" and "going out of commercial" cues, continuously monitoring the audio/data/video signal and designating the corresponding portion of the program as a commercial segment.

12. The method of identifying commercial segments according to claim 1 further comprising the steps of:

continuously searching the transcript information for an end of a commercial segment, wherein when a beginning and end of a commercial segment have been identified, storing at least one of the "non-stop" words and the transcript information interposed between the beginning and end of the commercial segment.

13. The method of identifying commercial segments according to claim 1 wherein if the "non-stop" words detected during the first time period occur more than the pre-determined number of times, the first time period is marked as a commercial area.

14. The method of identifying commercial segments according to claim 1 wherein the program is one of a broadcast television program, a broadcast radio program, internet or video/audio streaming, which can be multicast or unicast.

15. A method of learning and storing commercial segments which occur during a program comprising:

a. identifying a possible commercial segment which occurs during the program;

b. comparing "non-stop" words of the possible commercial segment with "non-stop" words of each of a list of probable commercial segments previously identified to determine at least one matching probable commercial segment having at least one common "non-stop" word with the possible commercial segment;

c. comparing transcript text of the possible commercial segment with transcript text of the at least one matching probable commercial segment;

d. storing the transcript text which is common to both the possible commercial segment and the at least one matching probable commercial segment;

e. automatically removing the at least one matching stored probable commercial segment from the list of probable commercial segments when the comparison of the transcript text of the possible commercial segment and the transcript text of the at least one matching probable commercial segment indicates they are substantially identical; and f. automatically adding the at least one matching probable commercial segment to a list of candidate commercial segments when the comparison of the transcript text of the possible commercial segment and the transcript text of the at least one matching probable commercial segment indicates they are substantially identical.

16. The method of learning and storing commercial segments according to claim 15 wherein step a comprises at least one of monitoring transcript information to identify "non-stop" words which occur more than a predetermined number of times.

17. The method of learning and storing commercial segments according to claim 15 wherein if the "non-stop" words of at least one of the probable commercial segments are not identified as matching the "non-stop" words of the possible commercial segment, the method further comprises the step of:

adding the possible commercial segment to the list of probable commercial segments.

18. The method of learning and storing commercial segments according to claim 15, wherein step a comprises:

1. using transcript information associated with the program;

2. detecting "non-stop" words in the transcript information during a first time period which occur more than a predetermined number of times;

3. detecting "non-stop" words in the transcript information during a second time period which occur more than a predetermined number of times; and 4. comparing the "non-stop" words detected during the first time period and the "non-stop" words detected during the second time period.

19. The method of learning and storing commercial segments according to claim 18 wherein the second time period overlaps in time with respect to the first time period.

20. The method of learning and storing commercial segments according to claim 18, the method further comprising the steps of:

receiving an audio/data/video signal which includes at least one of transcript information and electronic programming guide (EPG) data; and continuously monitoring the program for a beginning of a commercial segment, wherein steps 1–4 are performed after the beginning of a commercial segment has been identified.

21. The method of learning and storing commercial segments according to claim 18, wherein if the "non-stop" words detected during the first time period which occur more than the predetermined number of times are different from the "non-stop" words detected during the second time period which occur more than the predetermined number of times, the first time period is indicative of a first commercial segment and the second time period is indicative of a second commercial segment; and wherein if at least one of the "non-stop" words detected during the first time period which occur more than the predetermined number of times is the same as at least one of the "non-stop" words detected during the second time period which occur more than the predetermined number of times, the first time period and second time period are indicative of a common program segment.

22. The method of learning and storing commercial segments according to claim 21 further comprising the steps of:

detecting "non-stop" words in the transcript information during a third time period which occur more than a predetermined number of times, wherein if the "non-stop" words detected during the third time period which occur more than the predetermined number of times are different from the "non-stop" words detected during the second time period and the first time period, the third time period is indicative of a commercial segment which is not associated with the commercial segment of either of the first and second time periods, and wherein if the "non-stop" words detected during the third time period which occur more than the predetermined number of times are the same as the "non-stop" words detected during at least one of the second time period and first time period, the third time period is indicative of a commercial segment which is associated with the commercial segment of either of the corresponding first and second time periods.

23. The method of learning and storing commercial segments according to claim 22 wherein the third time period overlaps in time with respect to at least the second time period.

24. The method of learning and storing commercial segments according to claim 15, further comprising automatically creating the list of probable commercial segments by analyzing a plurality of possible commercial segments identified over time.

25. A method of learning and storing commercial segments which occur during a program comprising:

a. identifying a possible commercial segment which occurs during the program;

b. comparing "non-stop" words of the possible commercial segment with "non-stop" words of each of a list of candidate commercial segments previously identified to determine at least one matching candidate commercial segment having at least one common "non-stop" word with the possible commercial segment;

c. comparing transcript text of the possible commercial segment with transcript text of the at least one matching candidate commercial segment;

d. storing the transcript text which is common to both the possible commercial segment and the at least one matching candidate commercial segment;

e. automatically removing the at least one matching candidate commercial segment from the list of candidate commercial segments when the comparison of the transcript text of the possible commercial segment and the transcript text of the at least one matching candidate commercial segment indicates they are substantially identical; and f. automatically adding the at least one matching candidate commercial segment to a list of found commercial segments when the comparison of the transcript text of the possible commercial segment and the transcript text of the at least one matching candidate commercial segment indicates they are substantially identical.

26. The method of learning and storing commercial segments according to claim 25 wherein step a comprises at least one of monitoring transcript information to identify "nonstop" words which occur more than a predetermined number of times, and monitoring EPG data.

27. The method of learning and storing commercial segments according to claim 25 wherein if the "non-stop" words of at least one of the candidate commercial segments is not identified as matching the "non-stop" words of the possible commercial segment, the method further comprises:

comparing the possible commercial segment to a list of probable commercial segments.

28. The method of learning and storing commercial segments according to claim 25, wherein step a comprises:

1. using transcript information associated with the program;
2. detecting "non-stop" words in the transcript information during a first time period which occur more than a predetermined number of times;
3. detecting "non-stop" words in the transcript information during a second time period which occur more than a predetermined number of times; and
4. comparing the "non-stop" words detected during the first time period and the "non-stop" words detected during the second time period.

29. The method of identifying commercial segments according to claim 28 wherein the second time period overlaps in time with respect to the first time period.

30. The method of learning and storing commercial segments according to claim 28, the method further comprises the steps of:

receiving an audio/data/video signal which includes at least one of transcript information and electronic programming guide (EPG) data; and continuously monitoring the program for a beginning of a commercial segment, wherein steps 1–4 are performed only after the beginning of a commercial segment has been identified.

31. The method of learning and storing commercial segments according to claim 28, wherein if the "non-stop" words detected during the first time period which occur more than the predetermined number of times are different from the "non-stop" words detected during the second time period which occur more than the predetermined number of times, the first time period is indicative of a first commercial segment and the second time period is indicative of a second commercial segment; and wherein if at least one of the "non-stop" words detected during the first time period which occur more than the predetermined number of times is the same as at least one of the "non-stop" words detected during the second time period which occur more than the predetermined number of times, the first time period and second time period are indicative of a common program segment.

32. The method of learning and storing commercial segments according to claim 31 further comprising the steps of:

detecting "non-stop" words in the transcript information during a third time period which occur more than a predetermined number of times, wherein if the "non-stop" words detected during the third time period which occur more than the predetermined number of times are different from the "non-stop"

words detected during the second time period and the first time period, the third time period is indicative of a commercial segment which is not associated with the commercial segment of either of the first and second time period, and wherein if the "non-stop" words detected during the third time period which occur more than the predetermined number of times are the same as the "non-stop" words detected during at least one of the second time period and first time period, this indicative of a commercial segment which is not associated with the commercial segment of either of the first and second time period, the third time period is indicative of a commercial segment which is associated with the commercial segment of either of the corresponding first and second time periods.

33. The method of learning and storing commercial segments according to claim 32 wherein the third time period overlaps in time with respect to at least the second time period.

34. A method of learning and storing commercial segments which occur during a program comprising:

a. identifying a possible commercial segment which occurs during the program;

b. comparing "non-stop" words of the possible commercial segment with "non-stop" words of each of a list of found commercial segments previously identified to determine at least one matching found commercial segment having at least one common "non-stop" word with the possible commercial segment;

c. comparing transcript text of the possible commercial segment with transcript text of the at least one matching found commercial segment;

d. storing the transcript text which is common to both the possible commercial segment and the at least one matching found commercial segment;

e. associating a counter with each found commercial segment which indicates the frequency of occurrence of the found commercial segment;

f. incrementing the counter for the at least one matching found commercial segment when the comparison of the transcript text of the possible commercial segment and the transcript text of the at least one matching found commercial segment indicates they are substantially identical; and g. periodically determining whether the counter for any of the found commercial segments has not been incremented for a predetermined period of time and if so, removing the found commercial segment from the list of found commercial segments.

35. A method of learning and storing commercial segments according to claim 34 wherein if the "non-stop" words of at least one of the found commercial segments is not identified as matching the "non-stop" words of the possible commercial segment, comparing the "non-stop" words of the possible commercial segment to "non-stop" words of a list of candidate commercial segments.

36. A method of learning and storing commercial segments according to claim 35 wherein if the "non-stop" words of at least one of the stored candidate commercial segments is not identified as matching the "non-stop" words of the possible commercial segment, adding the possible commercial segment to the list of probable commercial segments.

37. The method of learning and storing commercial segments according to claim 34, wherein step a comprises:

1. using transcript information associated with the program;

2. detecting "non-stop" words in the transcript information during a first time period which occur more than a predetermined number of times;

3. detecting "non-stop" words in the transcript information during a second time period which occur more than a predetermined number of times; and 4. comparing the "non-stop" words detected during the first time period and the "non-stop" words detected during the second time period.

38. The method of learning and storing commercial segments according to claim 37 wherein the second time period overlaps in time with respect to the first time period.

39. The method of learning and storing commercial segments according to claim 37, the method further comprising the steps of:

receiving an audio/data/video signal which includes at least one of transcript information and electronic programming guide (EPG) data; and continuously monitoring the program for a beginning of a commercial segment, wherein steps 1–4 are performed only after the beginning of a commercial segment has been identified.

40. The method of learning and storing commercial segments according to claim 37, wherein if the "non-stop" words detected during the first time period which occur more than the predetermined number of times are different from the "non-stop" words detected during the second time period which occur more than the predetermined number of times, the first time period is indicative of a first commercial segment and the second time period is indicative of a second commercial segment; and wherein if at least one of the "non-stop" words detected during the first time period which occur more than the predetermined number of times is the same as at least one of the "non-stop" words detected during the second time period which occur more than the predetermined number of times, the first time period and second time period are indicative of a common program segment.

41. The method of learning and storing commercial segments according to claim 40 further comprising the steps of:

detecting "non-stop" words in the transcript information during a third time period which occur more than a predetermined number of times, wherein if the "non-stop" words detected during the third time period which occur more than the predetermined number of times are different from the "non-stop" words detected during the second time period and the first time period, the third time period is indicative of a commercial segment which is not associated with the commercial segment of either of the first and second time periods, and wherein if the "non-stop" words detected during the third time period which occur more than the predetermined number of times are the same as the "non-stop" words detected during at least one of the second time period and the first time period, the third time period is indicative of a commercial segment which is associated with the commercial segment of either of the corresponding at least one of the first and second time periods.

42. The method of learning and storing commercial segments according to claim 41 wherein the third time period overlaps in time with respect to at least the second time period.

43. A method of storing commercial segments and retrieving a stored commercial segment comprising:

a. storing commercial segments in a plurality of lists based on frequency of previous appearance of the commercial segments such that commercial segments appearing several times are in a different list than commercial segments appearing only once;

b. identifying at least one "non-stop" word indicative of a desired commercial segment;

c. identifying stored commercial segments which contain the identified "nonstop" word by analyzing all of the plurality of lists to determine whether any of the commercial segments in the lists contain the identified "non-stop" word; and d. outputting the identified stored commercial segments which contain the identified "non-stop" word.

44. The method of retrieving a stored commercial segment according to claim 43 further comprising the step of marking the identified stored commercial segment as a commercial area.

45. A method of learning and storing commercial segments which occur during a program comprising:

identifying a possible commercial segment which occurs during the program;

comparing "non-stop" words of the possible commercial segment with "non-stop" words of each of a list of found commercial segments previously identified to determine at least one matching found commercial segment having at least one common "non-stop" word with the possible commercial segment;

comparing the transcript text of the possible commercial segment with transcript text of the at least one matching found commercial segment;

storing the transcript text which is common to both the possible commercial segment and the at least one matching found commercial segment;

incrementing a counter which indicates the frequency of occurrence of the at least one matching found commercial segment; and wherein if the "non-stop" words of at least one of the found commercial segments is not identified as matching the "non-stop" words of the possible commercial segment, comparing the "non-stop" words of the possible commercial segment to "non-stop" words of a list of candidate commercial segments.

* * * * *